US006050497A

United States Patent [19]

Cotton

[11] Patent Number: 6,050,497

[45] Date of Patent: Apr. 18, 2000

[54] ROTATIONAL ACTUATION FLUID CONTROL VALVE FOR A HYDRAULICALLY ACTUATED FUEL INJECTOR

[75] Inventor: Clifford E. Cotton, Dunlap, Ill.

[73] Assignee: Caterpillar, Inc., Peoria, Ill.

[21] Appl. No.: 09/213,776

[22] Filed: Dec. 17, 1998

[51] Int. Cl.[7] ..... F02M 51/00

[52] U.S. Cl. ..... 239/96; 239/95; 239/88; 137/625.65; 137/625.22

[58] Field of Search ..... 239/88, 95, 96, 239/124; 137/625.65, 625.22

[56] References Cited

U.S. PATENT DOCUMENTS

| | | | |
|---|---|---|---|
| 2,543,010 | 2/1951 | Gardner | 137/139 |
| 3,347,262 | 10/1967 | Gibson | 137/375 |
| 4,431,161 | 2/1984 | Miller et al. | 251/133 |
| 4,632,358 | 12/1986 | Orth et al. | 251/117 |
| 4,735,233 | 4/1988 | Nogami et al. | 137/625.65 |
| 5,207,246 | 5/1993 | Meyer | 137/625.65 |
| 5,388,614 | 2/1995 | Hakamada et al. | 137/625.65 |
| 5,397,055 | 3/1995 | Paul et al. | 239/124 |
| 5,476,245 | 12/1995 | Augustin | 251/129.02 |
| 5,522,416 | 6/1996 | Farrell et al. | 137/625.65 |
| 5,687,693 | 11/1997 | Chen et al. | 123/446 |
| 5,738,075 | 4/1998 | Chen et al. | 123/446 |

*Primary Examiner*—Kevin Shaver
*Assistant Examiner*—David Deal
*Attorney, Agent, or Firm*—Eric M. Bram

[57] ABSTRACT

An actuation fluid control valve for a hydraulically actuated fuel injector comprises an injector body having a high pressure actuation fluid supply passage for admitting high pressure hydraulic actuation fluid into the fuel injector, an actuation fluid control passage for admitting the high-pressure hydraulic actuation fluid to commence fuel injection, a low-pressure actuation fluid drain passage for draining the hydraulic actuation fluid from the fuel injector, and a check valve fluid control passage for admitting the high pressure hydraulic actuation fluid to terminate fuel injection. An actuator is attached to the injector body. A rotatable valve member includes a first valve passage and a second valve passage and is disposed in the injector body such that high pressure actuation fluid entering from the high pressure actuation fluid supply passage will not bias the rotatable valve member either toward the first position or toward the second position. The rotatable valve member is rotatable in response to the actuator between a first position in which the high pressure actuation fluid supply passage is in fluid communication with the actuation fluid control passage via the first valve passage, and a second position in which the high pressure actuation fluid supply passage is not in fluid communication with the actuation fluid control passage.

16 Claims, 8 Drawing Sheets

POSITION 1

POSITION 1

POSITION 2

ROTATIONAL ACTUATION FLUID CONTROL VALVE FOR A HYDRAULICALLY ACTUATED FUEL INJECTOR

TECHNICAL FIELD

This invention relates generally to fuel injection, and more particularly to actuation valves for controlling actuation in hydraulically actuated fuel injectors.

BACKGROUND AND SUMMARY

Known hydraulically-actuated fuel injection systems and/or components are shown, for example, in U.S. Pat. Nos. 5,687,693 and 5,738,075 issued to Chen and Hafner et al. on Nov. 18, 1997 and Apr. 14, 1998, respectively.

In these hydraulically actuated fuel injectors, a spring biased needle check opens to commence fuel injection when pressure is raised by an intensifier piston/plunger assembly to a valve opening pressure. The intensifier piston is acted upon by a relatively high pressure actuation fluid, such as engine lubricating oil, when an actuator driven actuation fluid control valve, for example a solenoid driven actuation fluid control valve, opens the injector's high pressure inlet.

Injection is ended by operating the actuator to release pressure above the intensifier piston. This in turn causes a drop in fuel pressure causing the needle check to close under the action of its return spring and end injection.

Referring to FIGS. 5–7, a two-way solenoid fuel injector 14 utilizes a single two-way solenoid 130 to alternately open actuation fluid cavity 109 to actuation fluid inlet 106 or low pressure actuation fluid drain 104, and uses the same solenoid 130 to control both the exposure of a needle control chamber 118 to a low pressure passage or a source of high pressure fluid, by exploiting a hysteresis effect in the actuation fluid control valve versus the quick response of the needle valve member to the needle control valve.

Injector 14 includes an injector body 105 having an actuation fluid inlet 106 that is connected to a branch rail passage 40, an actuation fluid drain 104 that is connected to actuation fluid re-circulation line 27 and a fuel inlet 120 connected to a fuel supply passage 44. Injector 14 includes a hydraulic means for pressurizing fuel within the injector during each injection event and a needle control valve that controls the opening and closing of nozzle outlet 117.

The hydraulic means for pressurizing fuel includes an actuation fluid control valve that includes two-way solenoid 130 which is attached to a pin 135. An intensifier spool valve member 140 responds to movement of pin 135 and ball valve member 136 to alternately open actuation fluid cavity 109 to actuation fluid inlet 106 or low pressure drain 104. Actuation fluid cavity 109 opens to a stepped piston bore 110, 115 within which an intensifier piston 150 reciprocates between a return position (as shown) and a forward position. Injector body 105 also includes a plunger bore 111, within which a plunger 153 reciprocates between a retracted position (as shown) and an advanced position. A portion of plunger bore 111 and plunger 153 define a fuel pressurization chamber 112, within which fuel is pressurized during each injection event. Plunger 153 and intensifier piston 150 are returned to their retracted positions between injection events under the action of compression spring 154. Thus, the hydraulic means for pressurizing fuel includes the fuel pressurization chamber 112, plunger 153, intensifier piston 150, actuation fluid inlet 106, actuation fluid cavity 109 and the various components of the actuation fluid control valve, which includes solenoid 130, ball 136, pin 135 and intensifier spool valve member 140, etc.

Fuel enters injector 14 at fuel inlet 120 and travels past ball check 121, along a hidden fuel supply passage 124, and into fuel pressurization chamber 112, when plunger 153 is retracting. Ball check 121 prevents the reverse flow of fuel from fuel pressurization chamber 112 into the fuel supply passage during the plunger's downward stroke. Pressurized fuel travels from fuel pressurization chamber 112 via a connection passage 113 to nozzle chamber 114. A needle valve member 160 moves within nozzle chamber 114 between an open position in which nozzle outlet 117 is open and a closed position in which nozzle outlet 117 is closed. In this embodiment, needle valve member 160 includes a lower needle portion 161 and an upper intensifier portion 162 separated by spacers 164 and 166, which are all machined as separate components but could be machined as a single integral piece if spring 165 were relocated. Needle valve member 160 is mechanically biased to its closed position by a compression spring 165. Unlike the previous embodiment, compression spring 165 is compressed between spacer 164 and intensifier portion 162. Thus, in this embodiment, when needle valve member 160 is closed and needle control chamber 118 is open to low pressure, intensifier portion 162 is pushed to its upper stop.

Needle valve member 160 includes opening hydraulic surfaces 163 exposed to fluid pressure within nozzle chamber 114 and a closing hydraulic surface 167 exposed to fluid pressure within needle control chamber 118. As in the previous embodiment the closing hydraulic surface and the opening hydraulic surfaces are sized and arranged such that the needle valve member 160 is hydraulically biased toward its closed position when the needle control chamber 118 is open to a source of high pressure fluid. Thus, there should be adequate pressure on the closing hydraulic surface 167 to maintain nozzle outlet 117 closed despite the presence of high pressure fuel in nozzle chamber 114 that is otherwise above a valve opening pressure. The opening hydraulic surfaces 163 and closing hydraulic surface 167 are also preferably sized and arranged such that needle valve member 160 is hydraulically biased toward its open position when the needle control chamber 118 is connected to a low pressure passage and the fuel pressure within nozzle chamber 114 is greater than the valve opening pressure.

The actuation fluid control valve of injector 14 can be thought of as including two-way solenoid 130 that is attached to a pin 135 which is normally in contact with ball 136 except when pin 135 is fully retracted. Pin 135 is biased by a compression spring 138 and the hydraulic force on ball 136 toward a retracted position. In this position, ball 136 closes seat 172 and opens seat 173 so that high pressure actuation fluid flows into contact with the end hydraulic surface 141 of intensifier spool valve member 140. When solenoid 130 is de-energized, actuation fluid cavity 109 is opened to actuation fluid drain 104 past seat 170, and intensifier spool valve member 140 is hydraulically balanced and forced down, as shown, to close seat 171 and open seat 170. When solenoid 130 is energized, pin 135 moves downward causing ball 136 to open seat 172 and close seat 173. This causes end hydraulic surface 141 to be exposed to the low pressure in drain passage 129, which is connected to a second drain 108. This creates a hydraulic imbalance in intensifier spool valve member 140 causing it to move upward against the action of compression spring 145 to close seat 170 and open seat 171. This allows actuation fluid to flow from inlet 106, into the hollow interior 147 of intensifier spool valve member 140, through radial openings 146, past seat 171 and into actuation fluid cavity 109 to act upon the stepped top 155, 156 of the intensifier piston 150.

The opening and closing of the nozzle outlet 117 via needle valve member 160 is controlled by the needle control valve which includes solenoid 130. As stated earlier, when de-energized, pin 135 retracts under the action of compression spring 138 so that high pressure actuation fluid flowing through hollow interior 147 pushes ball 136 to open seat 173 and close seat 172. When in this configuration, the high pressure actuation fluid inlet 106 flows past seat 173 along a hidden passage into actuation fluid control passage 119. Actuation fluid control passage 119 opens to needle control chamber 118 and acts upon the closing hydraulic surface 167 of needle valve member 160, pushing the same downward to close nozzle outlet 117. When solenoid 130 is energized, pin 135 is moved downward pushing ball 136 to close seat 173 and open seat 172. This opens actuation fluid control passage 119 to the low pressure within drain passage 129, which is connected to second low pressure fluid drain 108. Drains 104 and 108 merge together outside of injector body 105. Thus, with the solenoid 130 energized, the closing hydraulic surface 167 of needle valve member 160 is now exposed to a low pressure passage and the needle valve member begins to behave like a simple check valve in that it will now open if fuel pressure within the nozzle chamber 114 is greater than a valve opening pressure sufficient to overcome return spring 165. In this embodiment, the needle control valve includes solenoid 130, pin 135, ball 136, seat 172 and seat 173. The actuation fluid control valve includes all the components of the needle control valve plus intensifier spool valve member 140, compression spring 145, seat 170 and seat 171.

In the injector 14 illustrated in FIGS. 5-7, each injection sequence is started by energizing the solenoid 130 in order to move ball 136 to open seat 172 and close seat 173. The pressurized fluid previously acting on the end hydraulic surface 141 of spool valve member 140 can drain past seat 172. Intensifier spool valve member 140 is now hydraulically imbalanced and begins to move upward against the action of compression spring 145. This opens seat 171 and closes seat 170. The main oil supply can now flow through radial openings 146, past seat 171, into actuation fluid cavity 109 to the top of intensifier piston 150, starting it moving downward. With intensifier piston 150 and plunger 153 moving downward, fuel pressure starts to build within fuel pressurization chamber 112, closing ball check 121. With the solenoid energized, needle control passage 119 is open to low pressure drain 129 such that needle valve member 160 will open when fuel pressure exceeds a valve opening pressure sufficient to compress return spring 165.

Since only the inner top portion 155 of intensifier piston 150 is exposed to the high pressure oil in actuation fluid cavity 109, the intensifier piston accelerates downward at a rate lower than it otherwise would if the full fluid pressure were acting over the complete top surface of the intensifier piston. The volume above annular top surface 156 of intensifier piston 150 is filled by fluid flowing through auxiliary passage 128. As the intensifier piston continues to move downward, it eventually reaches a point where the volume above space 156 is growing faster than fluid can be supplied via passage 128. This causes a momentary hesitation in the piston's downward movement resulting in a slower build-up of fuel pressure underneath plunger 153 in fuel pressurization chamber 112.

To end injection and allow the injector to refuel itself for the next cycle, solenoid 130 is deenergized. This causes ball 136 to open seat 173 and closes seat 172. This resumes the pressurized oil acting on closing hydraulic surface 167 and, with the help of return spring 165, causes needle valve member 160 to close and provide an abrupt end to the injection. The opening of seat 173 causes intensifier spool valve member 140 to again become hydraulically balanced so that compression spring 145 moves the same downward to close seat 171 and open seat 170. This allows actuation fluid in actuation fluid cavity 109 to drain into actuation fluid drain 104 so that intensifier piston 150 and plunger 153 can retract under the action of return spring 154. The lowering of fuel pressure within fuel pressurization chamber 112 causes ball check 121 to open. Replenishing fuel begins to flow into the injector for the next injection event.

It will be understood that the actuation fluid control valve, which admits the high pressure actuating fluid to the injector, is a critical component of this type of hydraulically actuated fuel injector is the actuation fluid control valve. However, it will be appreciated that the above valve is complicated and requires many moving parts.

Additionally, the solenoid driven actuation fluid control valve can suffer a pressure capability problem if actuation fluid pressure becomes too high, because the solenoid force may not be strong enough to overcome very high actuating fluid pressures that bias the valve in one direction. Also, because the actuation fluid pressure in the high pressure actuation fluid supply rail is not absolutely constant, there may be a stability problem caused by fluctuating actuation fluid pressure, so that the timing at which the fuel injection starts and stops can vary.

Additionally, there may be some inefficiency in that there is a very short period between when the valve is admitting high pressure actuation fluid to the injector, and when the valve is allowing the actuation fluid to drain from the injector, during which the passage that allows the actuation fluid to drain may be momentarily fluidly connected to the passage through which the high pressure actuation fluid is admitted. During this time, some hydraulic fluid (or rather, hydraulic fluid pressure) is wasted.

The invention is directed to addressing one or more of the problems set forth above.

DISCLOSURE OF THE INVENTION

An actuation fluid control valve for a hydraulically actuated fuel injector comprises an injector body having a high pressure actuation fluid supply passage for admitting high pressure hydraulic actuation fluid into the fuel injector, an actuation fluid control passage for admitting the high-pressure hydraulic actuation fluid to commence fuel injection, a low-pressure actuation fluid drain passage for draining the hydraulic actuation fluid from the fuel injector, and a check valve fluid control passage for admitting the high pressure hydraulic actuation fluid to terminate fuel injection.

An actuator is attached with the injector body. A rotatable valve member includes a first valve passage and a second valve passage and is disposed in the injector body such that high pressure actuation fluid entering from the high pressure actuation fluid supply passage will not bias the rotatable valve member either toward a first position in which fuel injection will occur or toward a second position in which fuel injection will not occur. The rotatable valve member is rotatable in response to the actuator between the first position, in which the high pressure actuation fluid supply passage is in fluid communication with the actuation fluid control passage via the first valve passage, and the second position, in which the high pressure actuation fluid supply passage is not in fluid communication with the actuation fluid control passage.

In another aspect of the invention, the rotatable valve member can be constructed so that there is an intermediate position between the first position and the second position, in which the actuation fluid control passage is not connected either to the low pressure actuation fluid drain passage, or to the high pressure actuation fluid supply passage.

DETAILED DESCRIPTION OF EXAMPLE EMBODIMENTS

Figure 1:
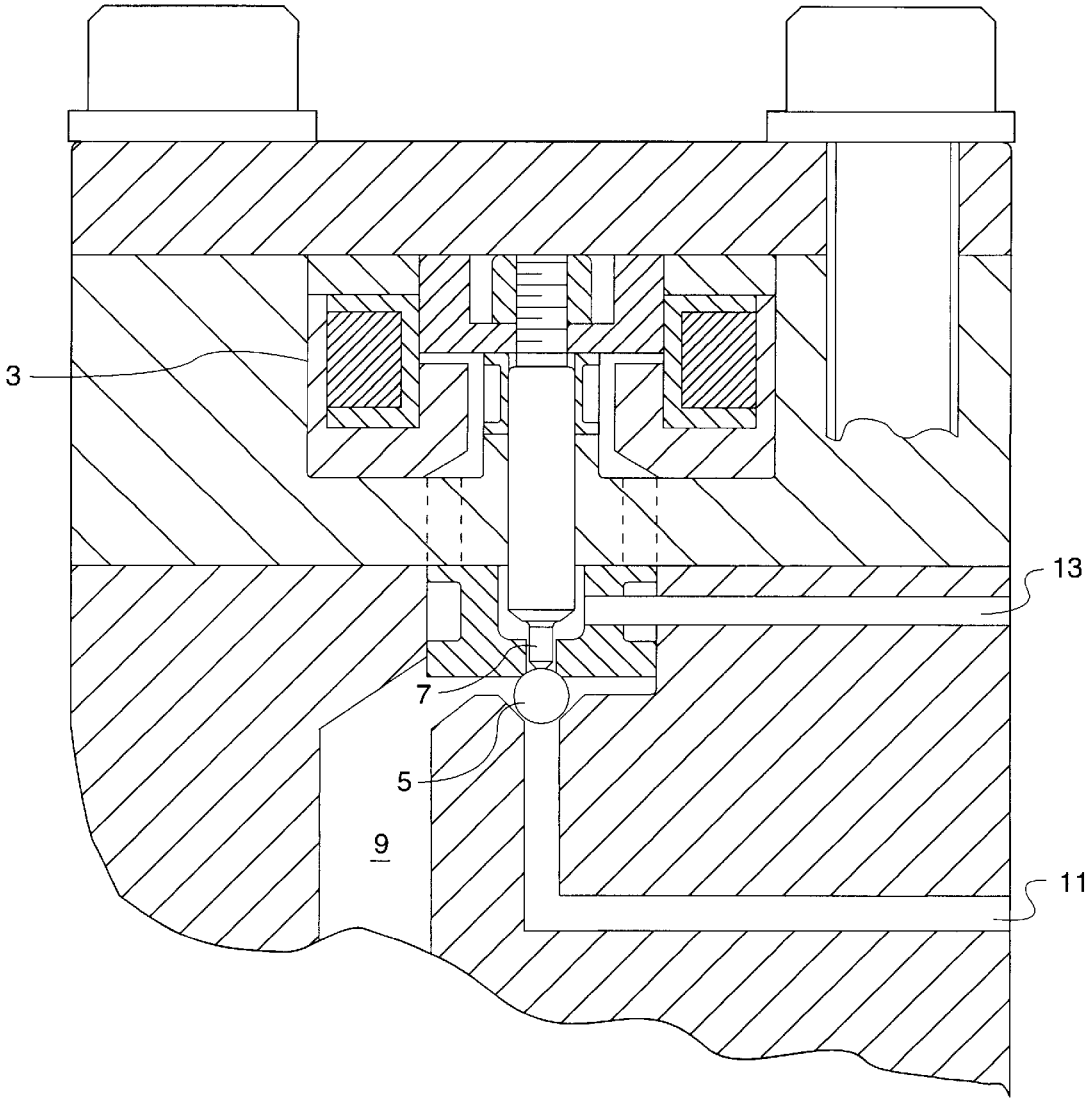
FIG. 1 illustrates a portion of a fuel injector utilizing an actuation fluid control valve including a solenoid, ball, and pin.

FIG. 1 illustrates an embodiment of a portion of a hydraulically-actuated electronically-controlled fuel injector utilizing an actuation fluid control valve including a solenoid 3, ball 5, and a pin 7. The solenoid 3 alternately opens an actuation fluid control passage 9 to a high-pressure actuation fluid supply passage 11 or to a low-pressure actuation fluid drain passage 13. It can be appreciated that with this design the high pressure actuation fluid entering from the high pressure actuation fluid supply passage 11 will bias the ball 5 toward a position in which high pressure actuation fluid is admitted from the high pressure actuation fluid supply passage 11 to the actuation fluid control passage 9. Thus, a pushing solenoid 3 must push the pin 7 and a ball 5 against the full pressure of the incoming high-pressure actuation fluid in the high-pressure actuation fluid supply passage 11. When this pressure becomes too high, it becomes difficult for the solenoid 3 to push the ball 5 quickly enough.

Additionally, because the actuation fluid pressure in the high-pressure actuation fluid supply passage 11 is not absolutely constant, the timing at which the ball 5 seals off the high pressure actuation fluid supply passage 11 can also vary. Also, there is some inefficiency in that there is a very short period during which the ball is between seats, at which time the high pressure actuation fluid supply passage 11 is momentarily fluidly connected to be low pressure actuation fluid drain passage 13. During this time, some hydraulic fluid (or rather, hydraulic fluid pressure) is wasted.

Figure 2A:
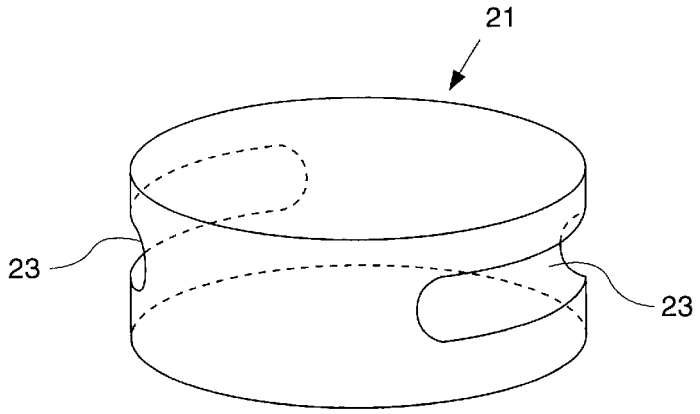
FIG. 2A is a perspective view of an embodiment of a valve cylinder used in a rotating actuation fluid control valve according to the invention.
Figure 2B:
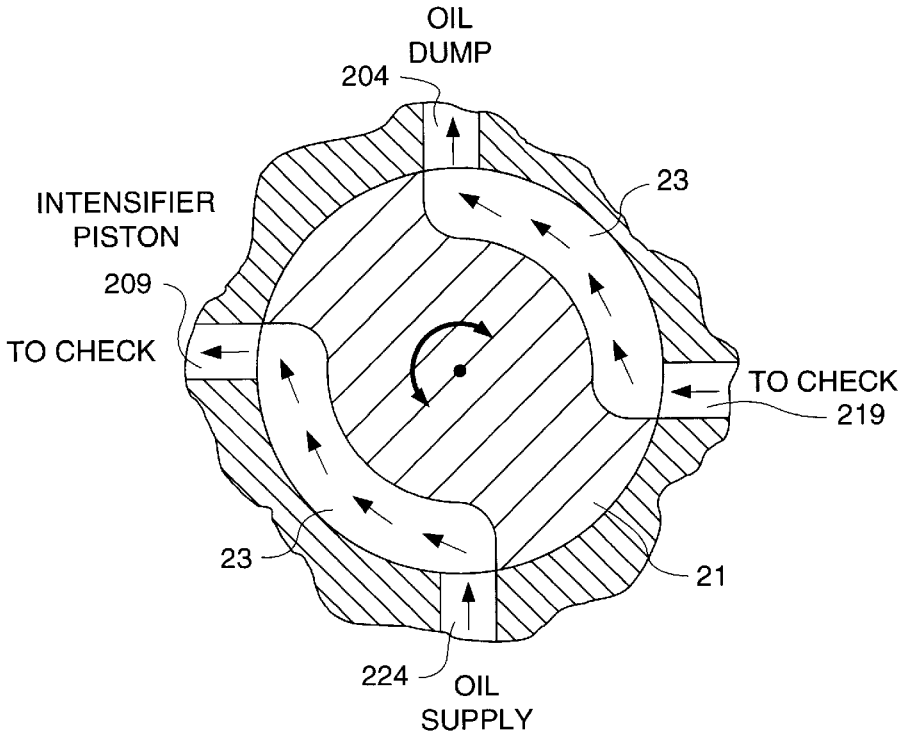
FIG. 2B is the valve cylinder of FIG. 2A viewed along its axis and positioned to commence fuel injection.
Figure 2C:
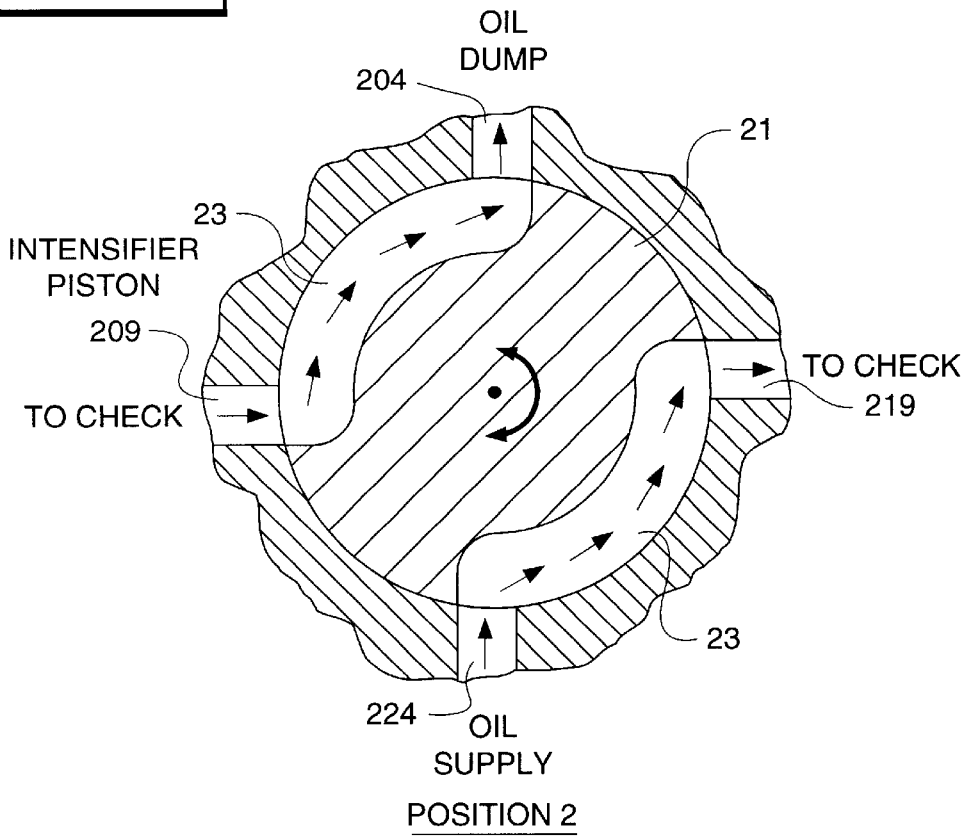
FIG. 2C is the valve cylinder of FIG. 2B positioned to cease fuel injection.

FIGS. 2A–2C illustrate an embodiment of a valve cylinder 21 for an actuation fluid control valve according to the invention. Radial grooves 23 are cut into opposite sides of a valve cylinder 21.

FIG. 2B shows the valve cylinder 21 positioned for commencement of fuel injection. In this first position, radial grooves 23 fluidly connect a high pressure hydraulic fluid supply passage 224 with an actuation fluid control passage 209, and a check valve fluid control passage 219 with a low-pressure actuation fluid drain passage 204.

FIG. 2C shows the valve cylinder 21 positioned for terminating fuel injection. In this second position, radial grooves 23 fluidly connect the actuation fluid control passage 209 with the low pressure actuation fluid drain passage 204, and the high pressure hydraulic fluid supply passage 224 with the check valve fluid control passage 219.

Figure 3A:
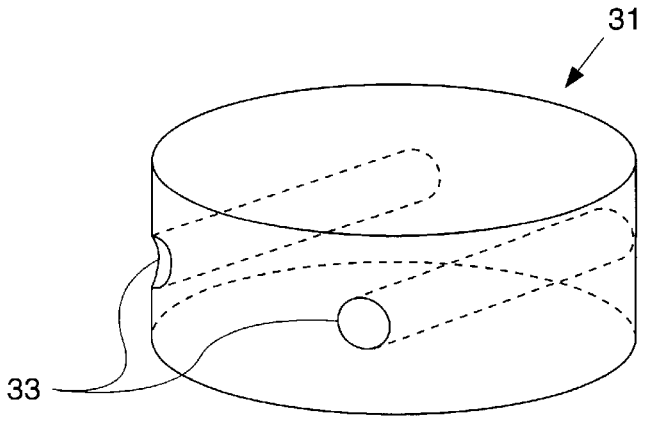
FIG. 3A is a perspective view of another embodiment of a valve cylinder used in a rotating actuation fluid control valve according to the invention.
Figure 3B:
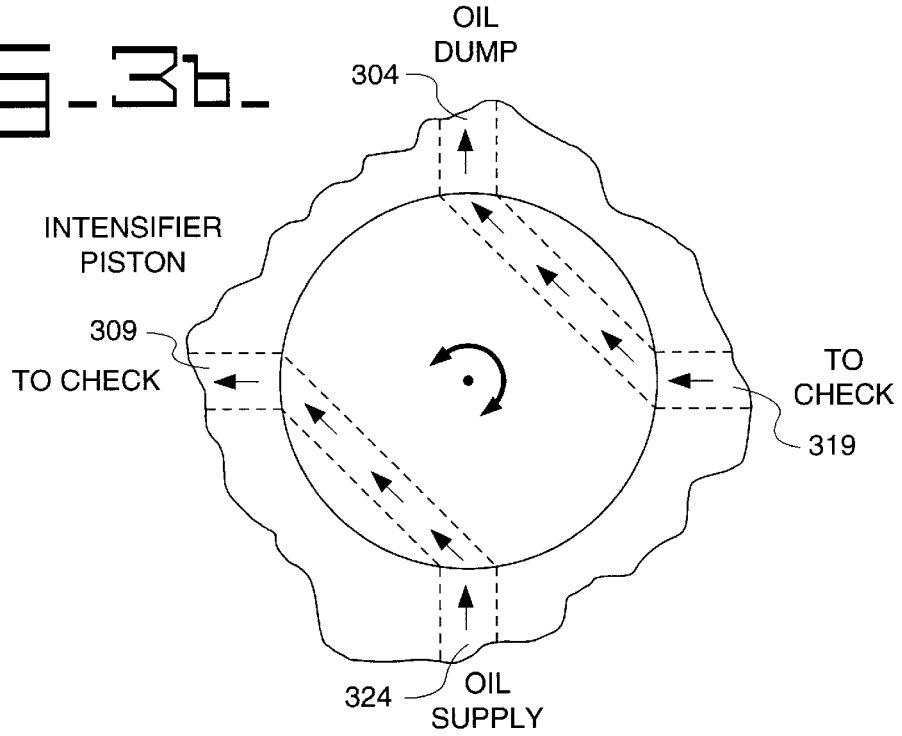
FIG. 3B is the valve cylinder of FIG. 3A viewed along its axis and positioned to commence fuel injection.
Figure 3C:
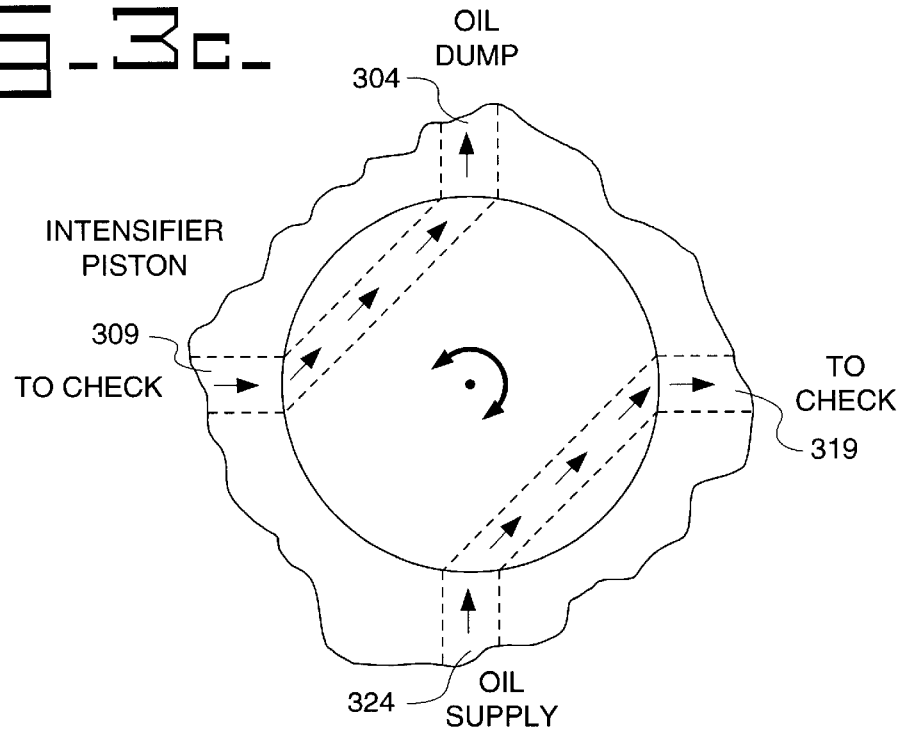
FIG. 3C is the valve cylinder of FIG. 3B positioned to cease fuel injection.

FIGS. 3A–3C illustrate another embodiment of a valve cylinder 31 for an actuation fluid control valve according to the invention. Through-holes 33 are cut through a valve cylinder 31.

FIG. 3B shows the valve cylinder 31 positioned for commencement of fuel injection. In this first position, through-holes 33 fluidly connect a high pressure hydraulic fluid supply passage 324 with an actuation fluid control passage 309, and a check valve fluid control passage 319 with a low-pressure actuation fluid drain passage 304.

FIG. 3C shows the valve cylinder 31 positioned for terminating fuel injection. In this second position, through-holes 33 fluidly connect the actuation fluid control passage 309 with the low pressure actuation fluid drain passage 304, and the high pressure hydraulic fluid supply passage 324 with the check valve fluid control passage 319.

Figure 4A:
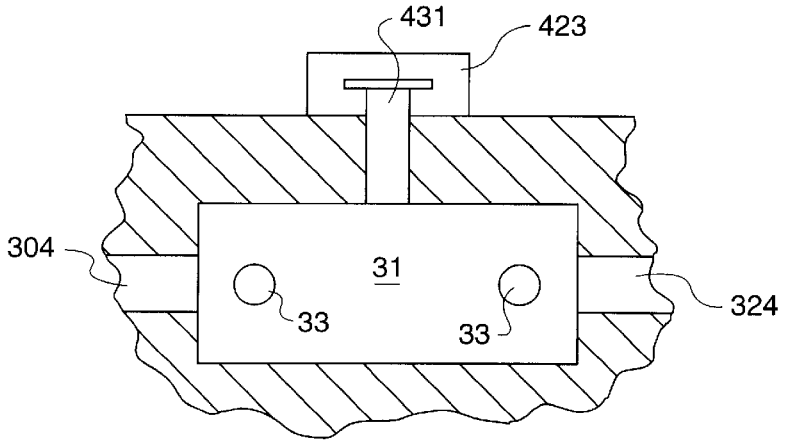
FIG. 4A is a side view of an embodiment of an actuation fluid control valve within a fuel injector according to the invention, using a rotational solenoid actuator, in an intermediate position.
Figure 4B:
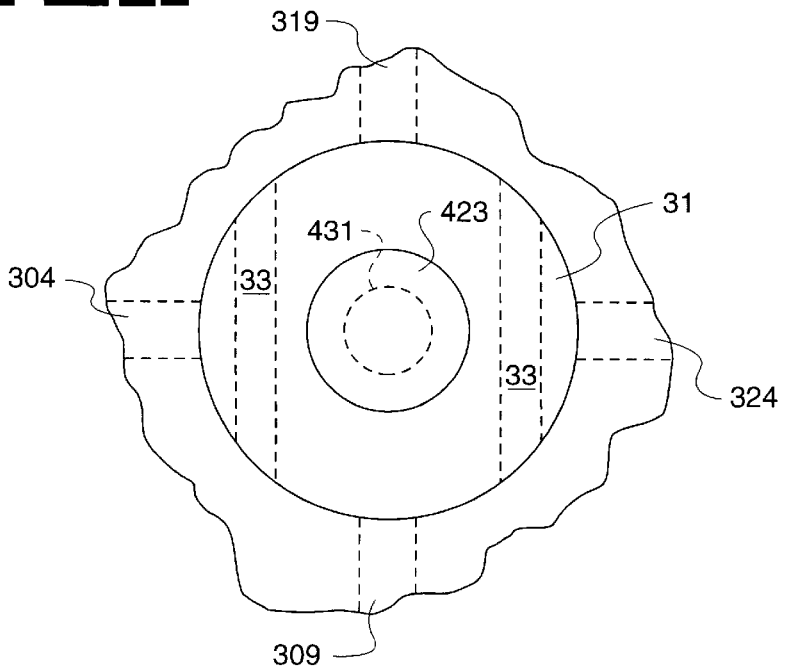
FIG. 4B is a top view of the embodiment of FIG. 4A.
Figure 5:
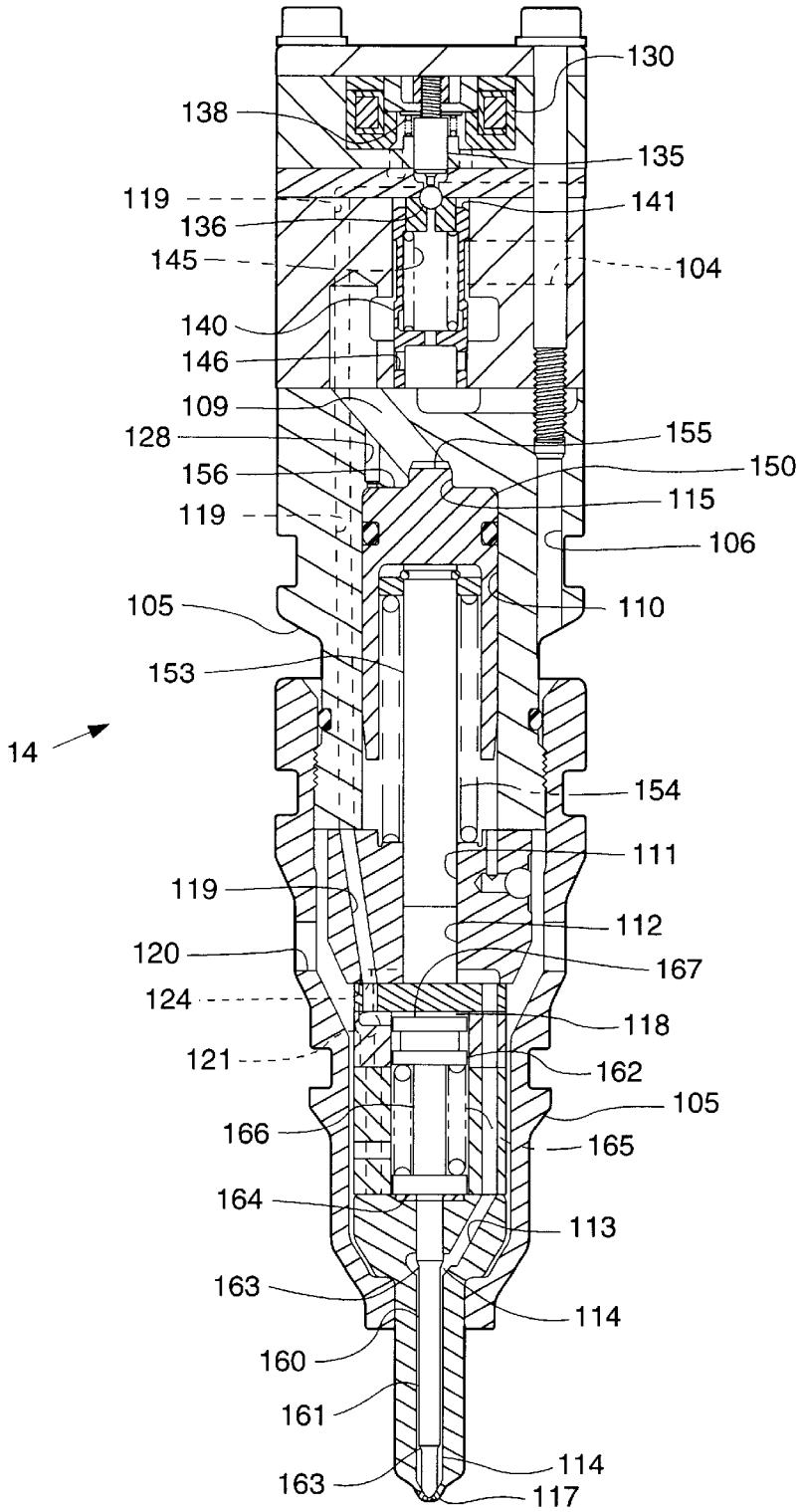
FIG. 5 is a sectioned side elevational view of a fuel injector utilizing a two-way solenoid actuator.
Figure 6:
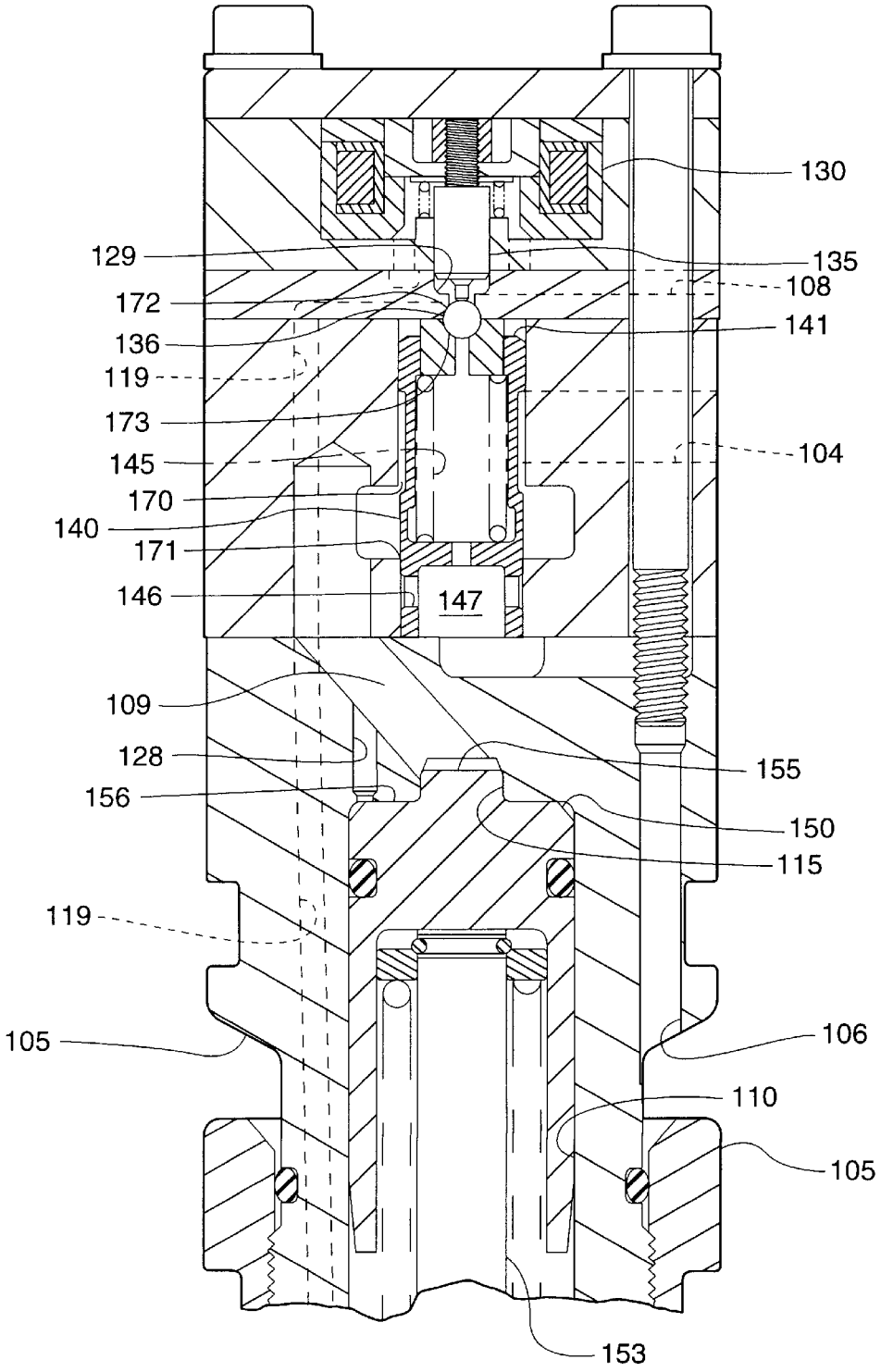
FIG. 6 is a partial sectioned side elevational view of an upper portion of the fuel injector shown in FIG. 5.
Figure 7:
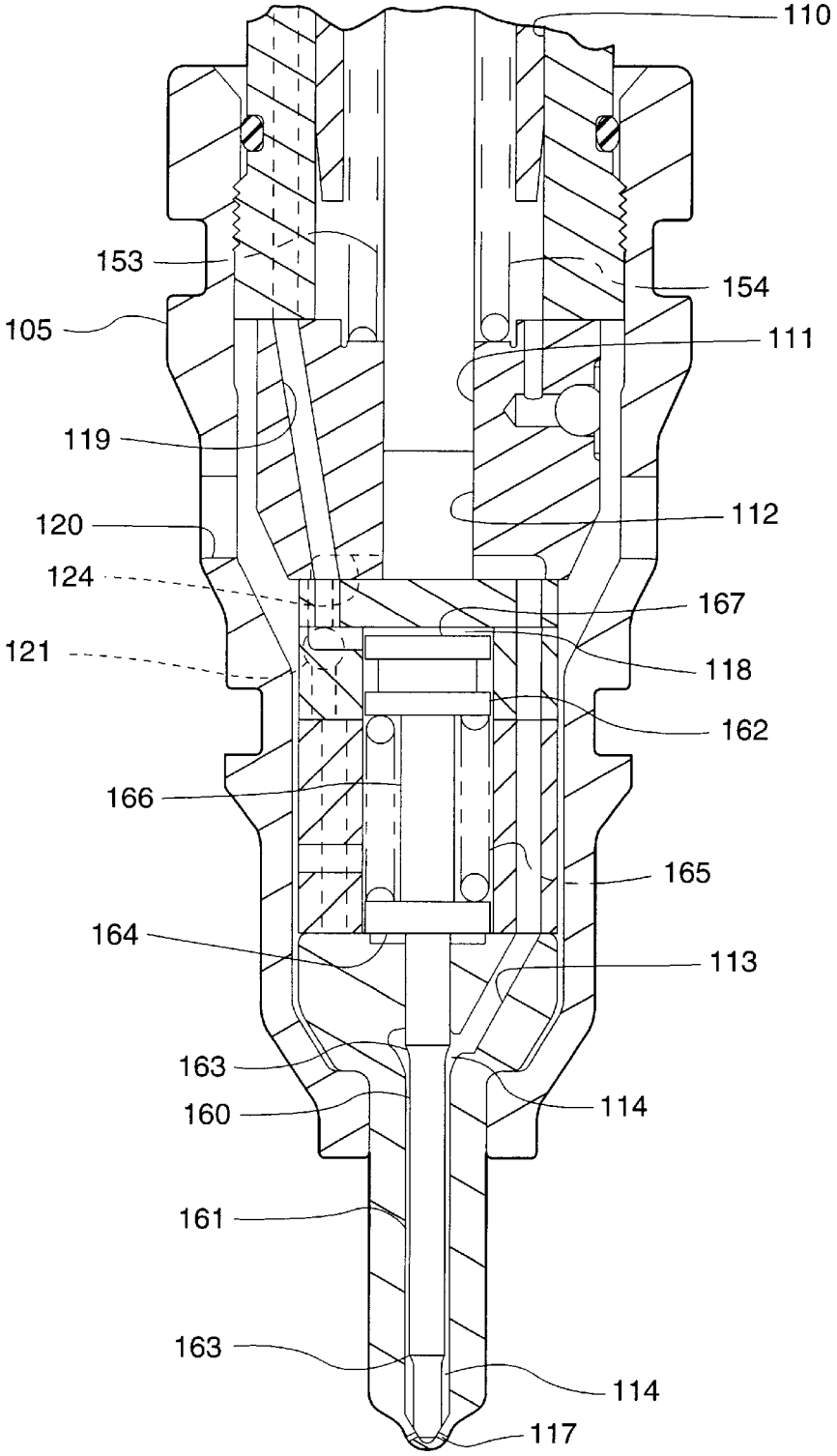
FIG. 7 is a partial sectioned side elevational view of the lower portion of the injector shown in FIG. 5.

FIGS. 4A and 4B illustrate an embodiment of an actuation fluid control valve within a fuel injector according to the invention, using a rotational solenoid actuator. This design comprises rotatable valve cylinder 31 attached to an armature 431 of a rotational solenoid 423. The rotatable valve cylinder 31 is movable with rotation of the armature 431 between a first position where an actuation fluid control passage 319 is fluidly connected with a high pressure hydraulic fluid supply passage 324, and a second position where the actuation fluid control passage 319 is fluidly connected with the low pressure actuation fluid drain passage 304. FIGS. for 4A and 4B show rotatable valve cylinder 31 in an intermediate position between the first position and the second position.

While the disclosed embodiment uses a rotating actuator, other embodiments can easily be envisioned in which instead of using a rotating actuator, a pushing or pulling actuator, for example comprising a solenoid or a piezo stack, can rotate the rotatable valve by pushing and pulling an arm or lever or such attached with the rotatable valve

Industrial Applicability

Referring now to the fuel injector portion illustrated in FIG. 4, each injection sequence is started by energizing rotational solenoid 423 to rotate the attached rotatable valve 31 to the first position, so that the actuation fluid control passage 319 is fluidly connected with a high pressure hydraulic fluid supply passage 324. The high-pressure actuation fluid can then flow into the actuation fluid control passage 309 to operate the fuel injector to allow fuel injection. Meanwhile, the check valve fluid control passage 319 is fluidly connected with the low-pressure actuation fluid drain passage 304, so that there is no high-pressure hydraulic fluid pushing check closed.

To end the injection sequence, the rotational solenoid 423 is again energized, this time to rotate the attached rotatable valve 31 to the second position, so that the actuation fluid control passage 309 is no longer fluidly connected with the high pressure hydraulic fuel supply passage 324. Instead, the actuation fluid control passage 309 is now fluidly connected with a low-pressure actuation fluid drain passage 304. At the same time, the high-pressure hydraulic fluid supply passage 324 becomes fluidly connected with the check valve fluid control passage 319. This exerts high pressure against the back of the check, which quickly closes a check and terminates fuel injection.

With this design, the actuation fluid control passage 309 is fluidly connected with the high pressure actuation fluid supply passage 324 at the first position, and is fluidly connected with the low pressure actuation fluid drain passage 304 at the second position. Conversely, the check valve fluid control passage 319 is fluidly connected with the low-pressure actuation fluid drain passage 304 at the first position, and is fluidly connected with a high-pressure actuation fluid supply passage 324 at the second position.

However, while changing from the first position to the second position, and vice versa, the rotational valve passes through an intermediate position (illustrated in FIGS. 4A and 4B) in which the high pressure hydraulic fluid supply passage 324 is not fluidly connected with the low-pressure actuation fluid drain passage 304.

The resulting design allows elimination of the ball, seats, pin, and associated alignment issues associated with these components. Additionally, impact wear from the pin's striking the ball is reduced, and the pressure capability issues are addressed as well. Also, timing becomes independent of any fluctuations in the pressure of the high-pressure actuation fluid.

Further, because the high pressure actuation fluid supply passage 324 is never fluidly connected to the low pressure actuation fluid drain passage 304, efficiency is improved because no hydraulic fluid is wasted during the switch from hydraulic fluid supplying to hydraulic fluid draining. Finally, the rotational valve design prevents the high pressure of the high-pressure actuation fluid from biasing the valve toward either position, so that position of the valve is determined more controllably by the actuator. Thus, fuel injection motion and controllability are significantly improved. Other aspects, objects, and advantages of this invention will be apparent from the drawings, the disclosure, and the appended claims.

I claim:

1. An actuation fluid control valve for a hydraulically actuated fuel injector, comprising:

an injector body having a high pressure actuation fluid supply passage for admitting high pressure hydraulic actuation fluid into the fuel injector, an actuation fluid control passage for admitting the high-pressure hydraulic actuation fluid to commence fuel injection, a low-pressure actuation fluid drain passage for draining the hydraulic actuation fluid from the fuel injector, and a check valve fluid control passage for admitting the high pressure hydraulic actuation fluid to terminate fuel injection;

an actuator attached to the injector body; and a rotatable valve member including a first valve passage and a second valve passage, disposed in the injector body such that high pressure actuation fluid entering from the high pressure actuation fluid supply passage will not bias the rotatable valve member either toward the first position or toward the second position, and rotatable in response to the actuator between a first position in which the high pressure actuation fluid supply passage is in fluid communication with the actuation fluid control passage via the first valve passage, and a second position in which the high pressure actuation fluid supply passage is not in fluid communication with the actuation fluid control passage.

2. The actuation fluid control valve of claim 1, wherein the high pressure actuation fluid supply passage is in fluid communication with the low pressure actuation fluid drain passage via the second valve passage when the rotatable valve member is in the second position.

3. The actuation fluid control valve of claim 2, wherein the high-pressure actuation fluid supply passage is not in fluid communication with the actuation fluid control passage when the rotatable valve member is in the second position.

4. The actuation fluid control valve of claim 3, wherein the high-pressure actuation fluid supply passage is not in fluid communication with the low-pressure actuation fluid drain passage when the rotatable valve member is in the first position.

5. The actuation fluid control valve of claim 4, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

6. The actuation fluid control valve of claim 3, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

7. The actuation fluid control valve of claim 2, wherein the high-pressure actuation fluid supply passage is not in fluid communication with the low-pressure actuation fluid drain passage when the rotatable valve member is in the first position.

8. The actuation fluid control valve of claim 7, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

9. The actuation fluid control valve of claim 2, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

10. The actuation fluid control valve of claim 1, wherein the high-pressure actuation fluid supply passage is not in fluid communication with the actuation fluid control passage when the rotatable valve member is in the second position.

11. The actuation fluid control valve of claim 10, wherein the high-pressure actuation fluid supply passage is not in fluid communication with the low-pressure actuation fluid drain passage when the rotatable valve member is in the first position.

12. The actuation fluid control valve of claim 11, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

13. The actuation fluid control valve of claim 4, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

14. The actuation fluid control valve of claim 1, wherein the high-pressure actuation fluid supply passage is not in fluid communication with the low-pressure actuation fluid drain passage when the rotatable valve member is in the first position.

15. The actuation fluid control valve of claim 14, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

16. The actuation fluid control valve of claim 1, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

* * * * *